US007526244B2

(12) United States Patent
Kayama et al.

(10) Patent No.: US 7,526,244 B2
(45) Date of Patent: Apr. 28, 2009

(54) IMAGE FORMING APPARATUS

(75) Inventors: Naonori Kayama, Susono (JP); Hiroaki Namiki, Kawasaki (JP); Shotaro Yoshimura, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/670,121

(22) Filed: Feb. 1, 2007

(65) Prior Publication Data

US 2007/0126174 A1 Jun. 7, 2007

Related U.S. Application Data

(63) Continuation of application No. 11/007,314, filed on Dec. 9, 2004, now Pat. No. 7,212,751.

(30) Foreign Application Priority Data

Dec. 24, 2003 (JP) ..... 2003-426693
Nov. 8, 2004 (JP) ..... 2004-323235

(51) Int. Cl.
*G03G 15/00* (2006.01)

(52) U.S. Cl. ..... 399/405; 399/21; 399/407

(58) Field of Classification Search ..... None
See application file for complete search history.

(56) References Cited

U.S. PATENT DOCUMENTS

| | | | | |
|---|---|---|---|---|
| 4,459,019 | A | 7/1984 | Yoshimura et al. | 355/75 |
| 5,033,731 | A | 7/1991 | Looney | 271/176 |
| 5,235,381 | A | 8/1993 | Namiki et al. | 355/72 |
| 5,238,235 | A | 8/1993 | Nitta et al. | 271/9 |
| 5,280,331 | A | 1/1994 | Namiki | 355/318 |
| 5,350,169 | A | 9/1994 | Hiroi et al. | 271/213 |
| 5,651,540 | A | 7/1997 | Watanabe et al. | 271/10.12 |
| 5,660,489 | A | 8/1997 | Ishii et al. | 400/641 |
| 5,963,754 | A * | 10/1999 | Itoh et al. | 399/21 |
| 6,067,439 | A | 5/2000 | Kadokura et al. | 399/388 |
| 6,179,287 | B1 | 1/2001 | Watanabe et al. | 271/215 |
| 6,775,486 | B2 | 8/2004 | Matsuyama et al. | 399/21 |
| 6,877,742 | B2 | 4/2005 | Nishikata et al. | 271/264 |
| 6,882,823 | B2 | 4/2005 | Matsuyama et al. | 399/401 |
| 2005/0141939 | A1 | 6/2005 | Kayama et al. | 399/405 |
| 2005/0152723 | A1 | 7/2005 | Nishikata et al. | 399/367 |

FOREIGN PATENT DOCUMENTS

| | | | |
|---|---|---|---|
| JP | 9-86757 | | 3/1997 |
| JP | 2002249273 | A * | 9/2002 |

* cited by examiner

*Primary Examiner*—Jill E Culler
*Assistant Examiner*—'Wyn' Q Ha
(74) *Attorney, Agent, or Firm*—Fitzpatrick, Cella, Harper & Scinto

(57) ABSTRACT

To provide an image forming apparatus including: a discharge tray which can moves between a first position capable of loading a discharged sheet and a second position that is separated from the first position; and a sheet loading amount detection sensor which has a sheet detection flag abutting against the upper surface of the sheet loaded on the discharge tray and capable of moving in accordance with a loading amount of the sheet loaded on the discharge tray, and detects the sheet loading amount by detecting a position of the sheet detection flag, wherein when the discharge tray means is located at the second position, the sheet detection flag is removed from a position capable of detecting the sheet loading amount.

21 Claims, 13 Drawing Sheets

FIG. 5

| | STATE OF APPARATUS | IMAGE FORMING APPARATUS DISCHARGE TRAY SWITCH | SHEET POST-PROCESSING DEVICE SWITCH | DETECT ELECTRIC CONNECTION BETWEEN IMAGE FORMING APPARATUS AND SHEET POST-PROCESSING DEVICE |
|---|---|---|---|---|
| ① | • DISCHARGE TRAY IS ATTACHED<br>• SHEET POST-PROCESSING DEVICE IS NOT ATTACHED<br>• CABLE IS NOT CONNECTED | ON | — | OFF |
| ② | • DISCHARGE TRAY IS TAKEN OFF<br>• SHEET POST-PROCESSING DEVICE IS NOT ATTACHED<br>• CABLE IS NOT CONNECTED | OFF | — | OFF |
| ③ | • DISCHARGE TRAY IS TAKEN OFF<br>• SHEET POST-PROCESSING DEVICE IS NOT ATTACHED<br>• CABLE IS CONNECTED | OFF | OFF | ON |
| ④ | • DISCHARGE TRAY IS TAKEN OFF<br>• SHEET POST-PROCESSING DEVICE IS ATTACHED<br>• CABLE IS CONNECTED | OFF | ON | ON |
| ⑤ | • DISCHARGE TRAY IS TAKEN OFF<br>• SHEET POST-PROCESSING DEVICE IS ATTACHED<br>• CABLE IS NOT CONNECTED | OFF | — | OFF |
| ⑥ | • DISCHARGE TRAY IS TAKEN OFF<br>• SHEET POST-PROCESSING DEVICE IS NOT ATTACHED<br>• CABLE IS NOT CONNECTED | OFF | — | OFF |

FIG. 8A STATE OF NOT FULL LOAD
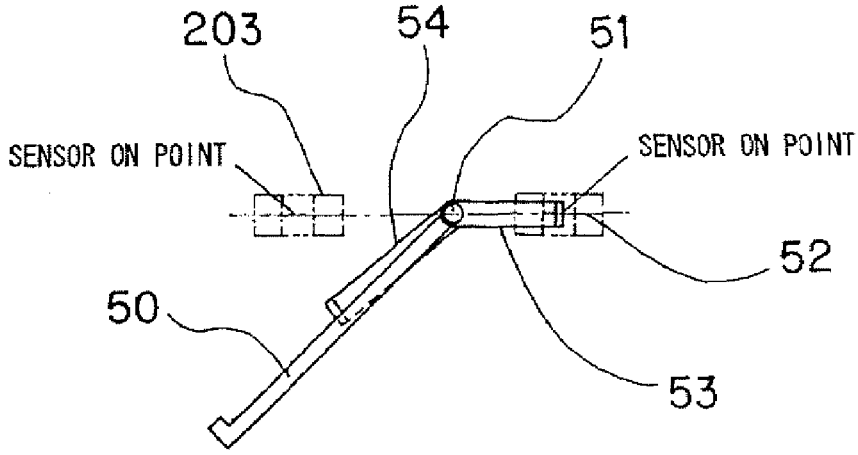
FIG. 8B STATE OF FULL LOAD
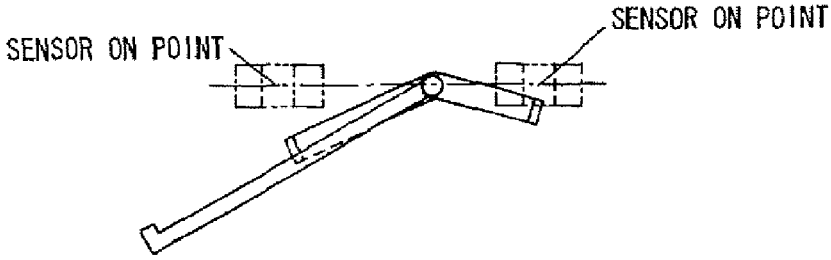
FIG. 8C STATE THAT LOADING TRAY IS NOT ATTACHED (POSITION WHERE FULL LOAD DETECTION FLAG IS REMOVED)
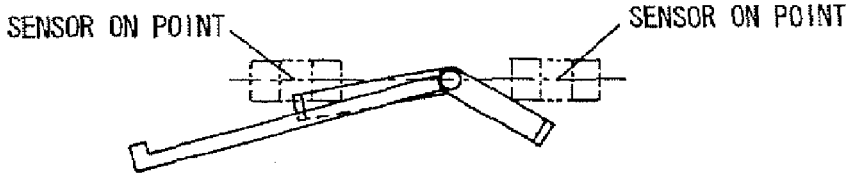
FIG. 8D STATE THAT SHEET POST-PROCESSING DEVICE IS ATTACHED (UPON CARRYING-IN OF SHEET)
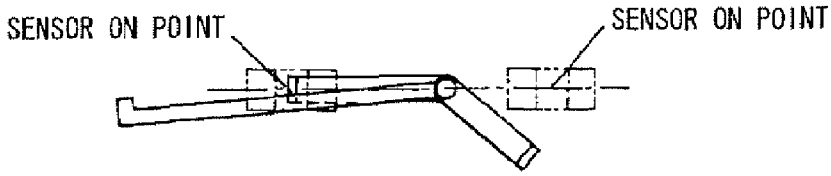

FIG. 10A STATE OF NOT FULL LOAD
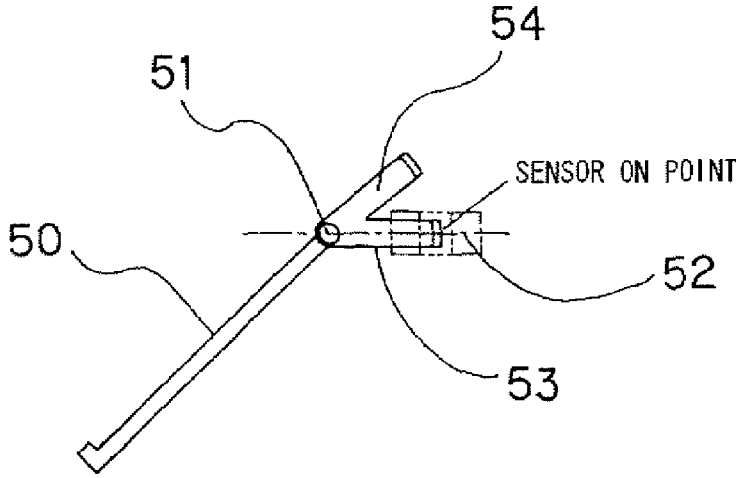
FIG. 10B STATE OF FULL LOAD
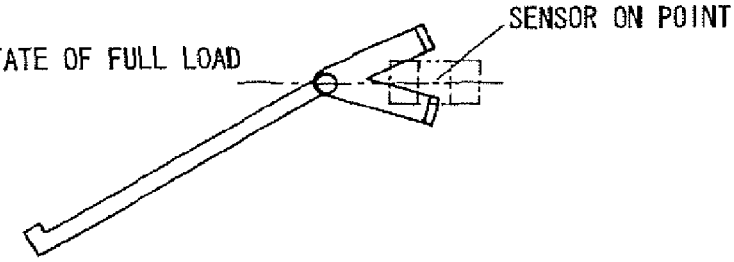
FIG. 10C STATE THAT LOADING TRAY IS NOT ATTACHED (POSITION WHERE FULL LOAD DETECTION FLAG IS REMOVED)
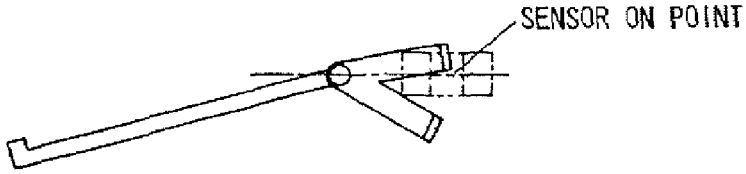
FIG. 10D STATE THAT SHEET POST-PROCESSING DEVICE IS ATTACHED (UPON CARRYING-IN OF SHEET)
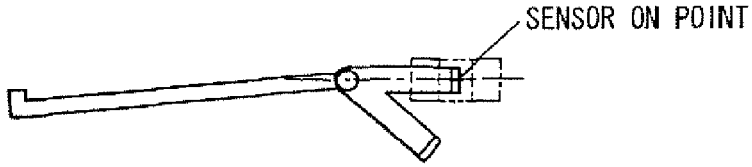

IMAGE FORMING APPARATUS

This application is a continuation of U.S. patent application Ser. No. 11/007,314, filed Dec. 9, 2004.

BACKGROUND OF THE INVENTION

1. Field of the Invention

The present invention relates to an image forming apparatus such as a printer for printing the digital information by using an electro photography, a multifunctional printer mounting an image reading apparatus at its upper part on the printer body as a base, and a printer provided with a sheet processing device or the like.

2. Description of the Related Art

Depending on digitalization of the information and an IT revolution or the like, a printer as one example of an image forming apparatus has been widely used and developed from a business use to a personal use and from monochrome to color. On the other hand, development of digitalization contributes to a complex function of the printer. Therefore, a printer characterized as an output of an information terminal such as a personal computer or the like so far has been characterized also as a product to integrate the functions such as a copying machine, a facsimile machine, and an image input apparatus or the like that are independent functions conventionally.

It is because a technical base of developing a new product characterized by a high cost performance and a little space such as plural functions by one machine has been put into place. A typical example of the product is a MFC (multifunction copier) which is made by digitalizing and giving a network function to the conventional copying machine or a MFP (multifunction printer) which is made by giving an image input function to the conventional printer.

According to such an image forming apparatus, a printed sheet is reversed in the middle of a path to convey the sheet by a sheet reversing apparatus that is provided in the image forming apparatus so as to be so-called FD (face down) discharged from a sheet discharge port disposed on a side of the image forming main body of the apparatus to a loading tray. Alternatively, without reversed, the printed sheet passes through the path so as to be so-called FU (face up) discharged from the sheet discharge port to the loading tray (refer to JP-A-09-086757).

According to such a conventional image forming apparatus, in the case that a sheet post-processing device for performing the processing to the sheet is not mounted, the sheet to be discharged from the discharge port of the image forming main body of the apparatus is discharged on the loading tray that is disposed at the side of the body. If a predetermined amount of the sheet is loaded on the loading tray, when the load amount attains to a predetermined upper limit a full load detection sensor flag that is disposed on the side of the image forming apparatus is mounted on the uppermost sheet, the full load detection sensor flag turns off a full load detection sensor, and the image forming apparatus stops its operation by an OFF signal from the full load detection sensor.

On the other hand, a sheet post-processing device may be disposed at the side surface of the sheet discharge port side. As the sheet post-processing device, a staple stacker has been known, which is disposed at the side surface of the sheet discharge port side of the image forming main body of the apparatus, adjusts respective end portions of the sheets sequentially fed from the sheet discharge port of the image forming main body of the apparatus, carries out the post-processing such as staple (pin) or the like, and discharge the sheets.

However, according to such a conventional image forming apparatus, when carrying out the operation such as jam clearance operation or the like at the periphery of the sheet discharge port, it is necessary to detach the parts such as an exterior at the periphery of the sheet discharge port and the sheet post-processing device. In this case, the full load detection sensor flag is left at an initial position. Therefore, the full load detection sensor flag interferes with the operation such as the jam clearance operation or the like and this sometimes involves a problem that the full load detection sensor flag is damaged.

In addition, the configuration of a connection part becomes complicated upon installation of the image forming apparatus on the sheet post-processing device, so that there is a problem that the cost becomes high and reliability is lowered due to increase of the number of the parts.

SUMMARY OF THE INVENTION

The present invention has been made taking the foregoing problems into consideration and an object of which is to provide an image forming apparatus with a high usability and a high reliability.

In order to attain the above-described object, the present invention may provide an image forming apparatus comprising: a discharge tray which can moves between a first position capable of loading a discharged sheet and a second position that is separated from the first position; and a sheet loading amount detection sensor which has a sheet detection flag abutting against the upper surface of the sheet loaded on the discharge tray and capable of moving in accordance with a loading amount of the sheet loaded on the discharge tray, and detects the sheet loading amount by detecting a position of the sheet detection flag; wherein, when the discharge tray is located at the second position, the sheet detection flag is removed from a position capable of detecting the sheet loading amount.

According to the present invention, by moving the discharge tray to be separated from the position where the sheets are loaded when carrying out the operation such as the jam clearance operation or the like at the periphery of the sheet discharge port, a sheet detection flag is removed from a position where it can detect the amount of the sheet loading (move to an removal position). Therefore, the sheet detection flag can evade damage of the sheet detection flag without interfering with the operation such as the jam clearance operation or the like and it is possible to provide an apparatus with a high usability and a high reliability.

In addition, since the sheet detection flag is removed to the removal position upon installation of the sheet post-processing device on the image forming apparatus, there is no fear that the sheet loading amount detection sensor is damaged by interference with the connection part at the side of the sheet post-processing device. Further, since the sheet detection flag functions as an in-sensor flag for detecting entering of the sheet into the sheet post-processing device, the configuration of the connection part between the image forming apparatus and the sheet post-processing device can be simplified, and since the number of the parts is decreased, it is possible to lower the cost. Further, since the configuration is simplified, it is possible to provide an apparatus with a high reliability.

BRIEF DESCRIPTION OF THE DRAWINGS

FIG. 5 is a table showing a connection state of the image forming apparatus and the sheet post-processing device according to the first embodiment;

FIG. 8A to 8D is a sectional view showing a positional relation between the full load detection sensor flag and a sheet in-sensor according to the second embodiment;

FIG. 10A to 10D is a sectional view showing a positional relation between the full load detection sensor flag and a sheet in-sensor according to the third embodiment;

DETAILED DESCRIPTION OF THE PREFERRED EMBODIMENTS

The preferred embodiments of the present invention will be described in detail with reference to the drawings below. However, a scope of the present invention is not limited only to a measurement, a material, a shape, and a relative position of a constituent part described in this embodiment unless there is a special description.

In the following respective embodiments, an example of an image forming apparatus represented by a multifunction printer of a laser printer base will be described.

A First Embodiment (Description of an Image Forming Apparatus)

With reference to FIGS. 1 to 6, the image forming apparatus according to the first embodiment will be described below.

Figure 2:
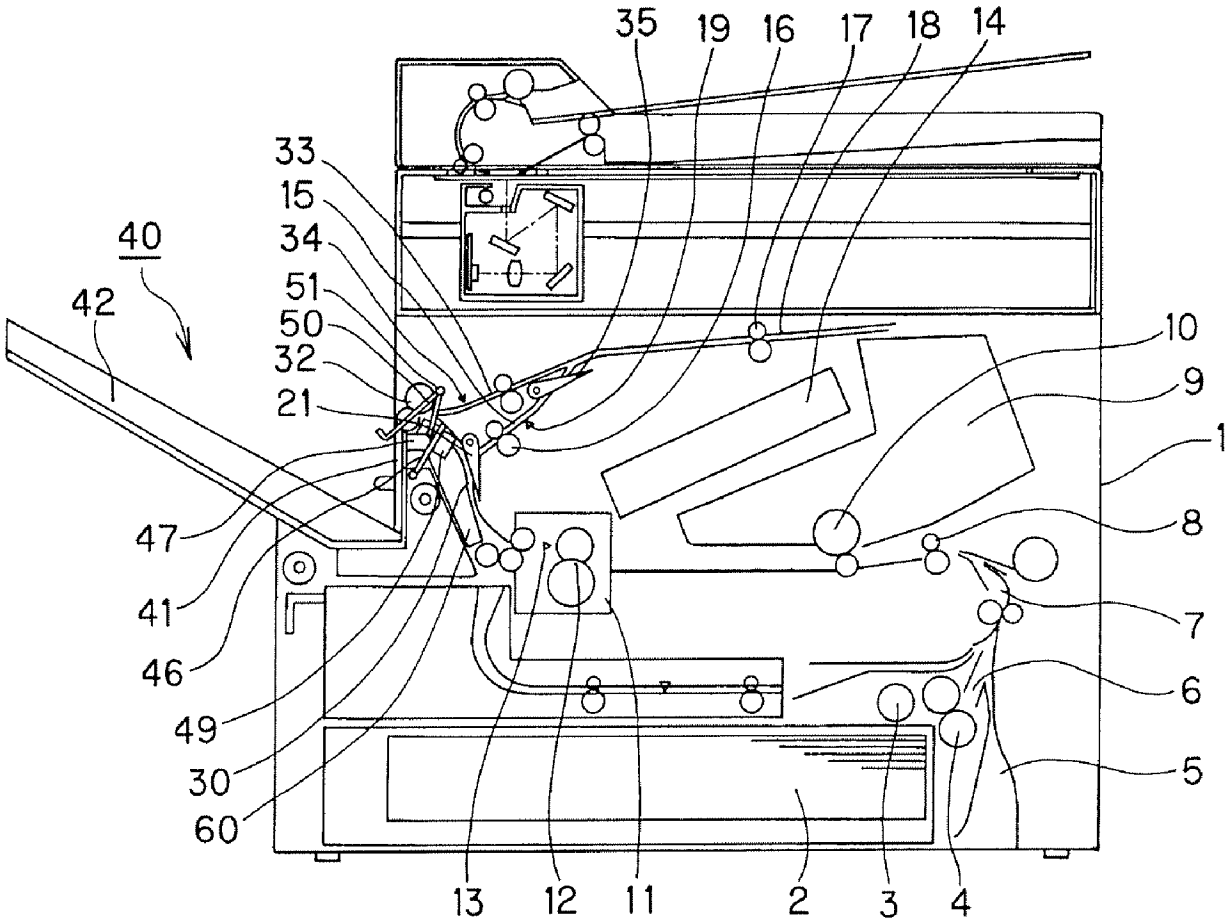
FIG. 2 is a longitudinal sectional view showing a state that a discharging tray is installed in the image forming apparatus according to the first embodiment.

FIG. 2 is a main sectional view showing a sheet transport path. In FIG. 2, a reference numeral 1 denotes an image forming apparatus provided with an image reading unit; a reference numeral 2 denotes a sheet feeding cassette; a reference numeral 3 denotes a sheet feeding roller; a reference numeral 4 denotes a pair of separation and transport rollers; reference numerals 5, 6, and 7 denote transport paths, respectively; a reference numeral 8 denotes a resist roller; a reference numeral 9 denotes an image forming process unit; a reference numeral 10 denotes an image forming drum; a reference numeral 11 denotes a fixing device; a reference numeral 12 denotes a pair of fixing discharge rollers; a reference numeral 13 denotes a fixing discharge sensor; and a reference numeral 14 denotes a writing scanner for forming an image.

On the basis of the image data read by the image reading unit or the like, the writing scanner 14 may write a latent image on the image forming drum 10. The written latent image is developed by a toner of the image forming process unit 9. The sheet which is taken out from the sheet feeding cassette 2 by the sheet feeding roller 3 is separated into one by one via the pair of separation and transport rollers 4, and passes through the transport paths 6 and 7. Then, the sheet is fed to the image forming drum 10 with synchronized at the resist roller 8 and a toner image on the image forming drum 10 is transferred on the sheet. The sheet on which the toner image is transferred is fed to a fixing device 11 to be pressurized with heat by the pair of fixing discharge rollers 12 and the toner image is fused and fixed on the sheet.

In this case, a discharge tray 40 as an example of the loading means is disposed on the side surface of the image forming main body of the apparatus. In order to discharge the sheet on this discharge tray 40, two discharge paths are set. At first, an A transport path 15 is provided, whereby the sheet is U-turned and fed on the upper part of the writing scanner 14 by the pair of fixing discharge rollers 12 to be reversed and discharged; and a B transport path 30 for directly discharging the sheet on the discharge tray 40.

Switching to the A transport path 15 is carried out by an FD/FU flapper 21 to be disposed at a downstream side of the pair of fixing discharge rollers 12. A junction roller pair 16 is disposed at a downstream side of the flapper 21 and at the middle part of the A transport path 15 and a reverse roller pair 17 is disposed at the upper part of the image forming unit. This reverse roller pair 17 is configures so as to reverse the direction of transportation of the sheet in order to feed the sheet to a C transport path 33 described below.

A lead-in transport path 18 is formed at a further downstream side of the reverse roller pair 17 and the lead-in transport path 18 is configured in such a manner that its end portion passes over the image forming process unit 9 and comes round the image forming process unit 9 so as to prevent a sheet end from getting out of the apparatus. At the middle part of the A transport path 15, a sheet detection sensor 19 is also disposed.

Switching to the B transport path 30 to directly discharge the sheet to the discharge tray 40 is carried out by the FD/FU flapper 21 and the sheet is discharged to the discharge tray 40 via a discharge roller pair 32. In the case of discharging the sheet via this B transport path 30, the sheet is discharged to the discharge tray 40 with faced up.

The C transport path 33 is provided to connect the reverse roller pair 17 to the discharge roller pair 32, and at the upstream of the discharge roller pair 32, a sheet detection sensor 34 is provided.

In addition, before the reverse roller pair 17 and in the vicinity of the junction portion of the A transport path 15 and the C transport path 33, a reverse flapper 35 is provided. This reverse flapper 35 is always biased to a side to block the A transport path 15 and the reverse flapper 35 may be pushed and released by a transportation force of the sheet, for example, by setting a light bias force. Alternatively, the transport path may be switched at timing by a solenoid or the like.

In the case of discharging the sheet via the A transport path 15 and the C transport path 33, the sheet is discharged to the discharge tray 40 with faced down.

At a full load detection sensor flag 50 as an example of the sheet detection part, a full load detection sensor light shielding part 53 is disposed at a swing center 51. When discharging and loading the sheet from the image forming apparatus 1 to the discharge tray 40, before the sheet is loaded to a predetermined height, the full load detection sensor light shielding part 53 disposed at the full load detection sensor flag 50 shields the light from a full load detection sensor 52.

When the sheet is discharged or the sheet is loaded to a predetermined height, a front end of the full load detection sensor flag 50 is loaded on the upper surface of the sheet to be swing around the swing center 51. In addition, also by the discharge operation of the sheet, the full load detection sensor flag 50 swings and the full load detection sensor light shielding part 53 does not shield the light from the full load detection sensor 52, so that the full load detection sensor 52 may detect timing of next shielding and detect that the sheet is normally discharged. In addition, detecting that the light from the full load detection sensor 52 has not been shielded continuously over a predetermined time (normally, time sufficiently longer than time of discharging one sheet), the full load detection sensor 52 may detect that the loading height of the sheet on a tray 42 as a loading part attains to the upper limit and the image forming apparatus 1 may stop.

In the meantime, according to the present embodiment, detecting that the full load detection sensor light shielding part 53 has not shield the light from the full load detection sensor 52 during a predetermined time, the full load state is determined, however, detecting that the full load detection sensor light shielding part 53 has shield the light from the full load detection sensor 52 during a predetermined time, the full load state may be determined.

(Explanation of Slide Operation of a Discharge Tray)

In order to describe the operation of the full load detection sensor flag 50 with reference to FIGS. 1 and 2, a case that the sheet is left in the B transport path 30 and a case that the sheet post-processing device is attached to the image forming apparatus 1 will be described below.

Figure 1:
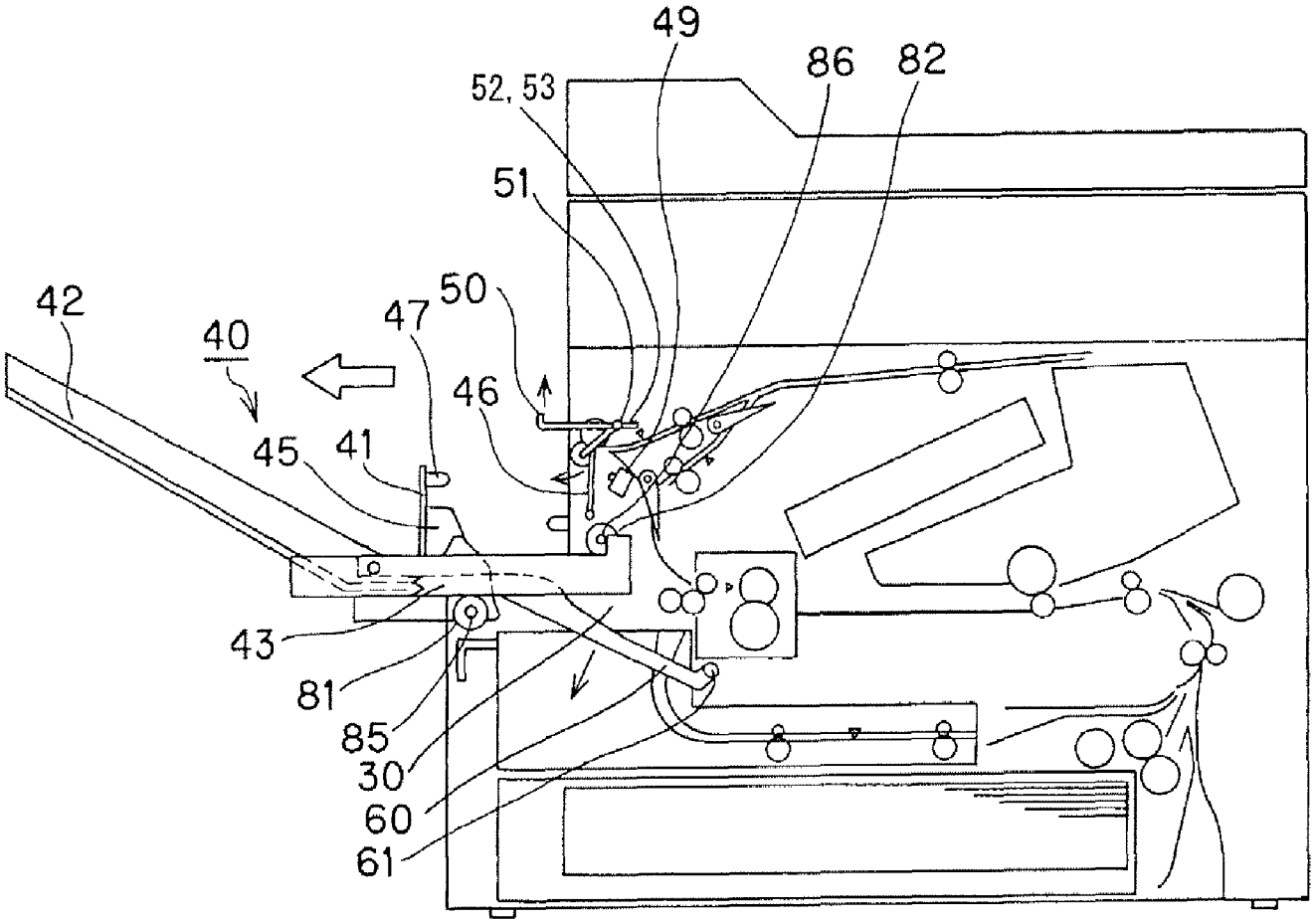
FIG. 1 is a longitudinal sectional view showing a schematic configuration of an image forming apparatus according to a first embodiment.

The discharge tray 40 shown in FIG. 1 is composed of a load wall 41, a tray 42, a rail 43 fixed at front and rear sides of the tray 42, an exterior cover (not illustrated), and a flip-up member 45 or the like.

The rail 43 is disposed as a bar-type rail on the discharge tray 40 and gains entrance into the image forming apparatus 1.

By rollers 81 and 82 that are disposed at a frame of the image forming apparatus 1 to freely swing with respect to axes 85, 86 that are disposed at the frame, the rail 43 may support a weight of the discharge tray 40 slidably in a horizontally direction.

An FU guide 60 composing a guide at the outside of the B transport path 30 may rotate around a swing center 61 by its own weight in a counterclockwise direction. The position of the FU guide 60 is limited as shown in FIG. 2 by abutting the flip-up member 45 disposed at the discharge tray 40 against the FU guide 60.

A projection 47 is disposed at the discharge tray 40. A discharge tray detection member 46 is provided to freely swing around a swing center and it is biased by a spring in a counterclockwise direction. As shown in FIG. 2, when the tray 42 is located at a first position in which the tray 42 can receive and carry the discharged sheet upon the normal operation of the image forming apparatus 1, the projection 47 presses the discharge tray detection member 46; then, the discharge tray detection member 46 swings in a clockwise direction to press a discharge tray switch 49 as one example of the position detection means; and the discharge tray switch 49 is turned on. As a result, the image forming apparatus 1 may detect that the tray 42 is located at the first position.

FIG. 1 shows a state that the discharge tray 40 is pulled out. In the case that a user carries out the jam clearance operation for the sheet that is left in the B transport path 30, the user pulls out the tray 42 to a left side, namely, to a second position with putting his or her hand on a handle to make the state shown in FIG. 1.

When the flip-up member 45 is removed to a left side in conjunction with the slide operation of the discharge tray 40 and the FU guide 60 swings about the swing center 61, the B transport path 30 is sufficiently released so as to enable accessing to the sheet in the B transport path 30.

Thus, when the tray 42 is located at the second position to which the tray 42 is pulled out, the projection 47 is separated from the discharge tray detection member 46, so that the discharge tray detection member 46 biased by the spring while swings in a counterclockwise direction and separated from the discharge tray switch 49. Accordingly, since the discharge tray switch 49 is turned off, the image forming apparatus 1 detects that the tray 42 is pulled out to be located at the second position.

If the user completes the jam clearance operation of the sheet, the user may slide the discharge tray 40 to the right side. By abutting against the FU guide 60, the flip-up member 45 swings in a clockwise direction, and when the tray 42 slides to the first position, the B transport path 30 which is in a state of transporting the sheet is formed.

Due to these configurations, in conjunction with the slide operation of the discharge tray 40, the B transport path 30 is opened and closed, and this makes it possible for the user to easily carry out the jam clearance operation of the sheet.

(Explanation with Regard to the Removal Operation of the Full Load Detection Sensor Flag)

As shown in FIG. 2, when the tray 42 is located at the first position, the projection 47 may press the discharge tray detection member 46 to swing it to a predetermined position. In this time, the full load detection sensor flag 50 may swing by its own weight about the swing center 51 to be located at a predetermined standby position. The full load detection sensor 52 uses a photo sensor.

Then, if the sheet is continuously loaded on the tray 42, the full load detection sensor flag 50 contacts the upper surface of the sheet, and further, if the sheet is continuously loaded to a predetermined upper limit, the full load detection sensor light shielding part 53 of the full load detection sensor flag 50 does not shield the light from the full load detection sensor 52, so that it is detected that the sheet on the tray 42 attains to the limit amount of loading.

When the tray 42 slides from the image forming apparatus 1 to the left side to be located at the second position (FIG. 1), the projection 47 is separated from the discharge tray detection member 46 and the discharge tray detection member 46 is biased by the spring to swing to a predetermined position. In this case, the discharge tray detection member 46 flips up a branch portion that is branched and elongated from the swing center 51 of the full load detection sensor flag 50, and the full load detection sensor flag 50 swings to a predetermined removal position in a direction represented by an arrow in FIG. 1. The removal position of the full load detection sensor flag 50 is a position where the user's hand does not contact the full load detection sensor flag 50 when the user inserts his or her hand inside of the image forming apparatus 1 to carry out the jam clearance operation.

If the user completes the jam clearance operation of the sheet, the user may slide the discharge tray 40 to the right side. When the tray 42 is located at the first position, the projection 47 may press the discharge tray detection member 46 to swing it to a predetermined position. Then, the discharge tray detection member 46 is separated from the branch portion of the full load detection sensor flag 50 and the full load detection sensor flag 50 may return to a predetermined standby position by its own weight.

As described above, since the removal position of the full load detection sensor flag 50 is a position where the user does not contact the full load detection sensor flag 50 upon the jam clearance operation, the user can carry out the jam clearance operation without interfered by the full load detection sensor flag 50 and this makes it possible to improve the operationality. In addition, since there is no possibility to accidentally damage the full load detection sensor flag 50, the reliability can be improved.

(Explanation with Regard to Attachment of a Sheet Post-processing Device)

A case that the discharge tray 40 that is attached in a default configuration is removed from the image forming apparatus 1 and the sheet post-processing device is attached will be described below.

Figure 3:
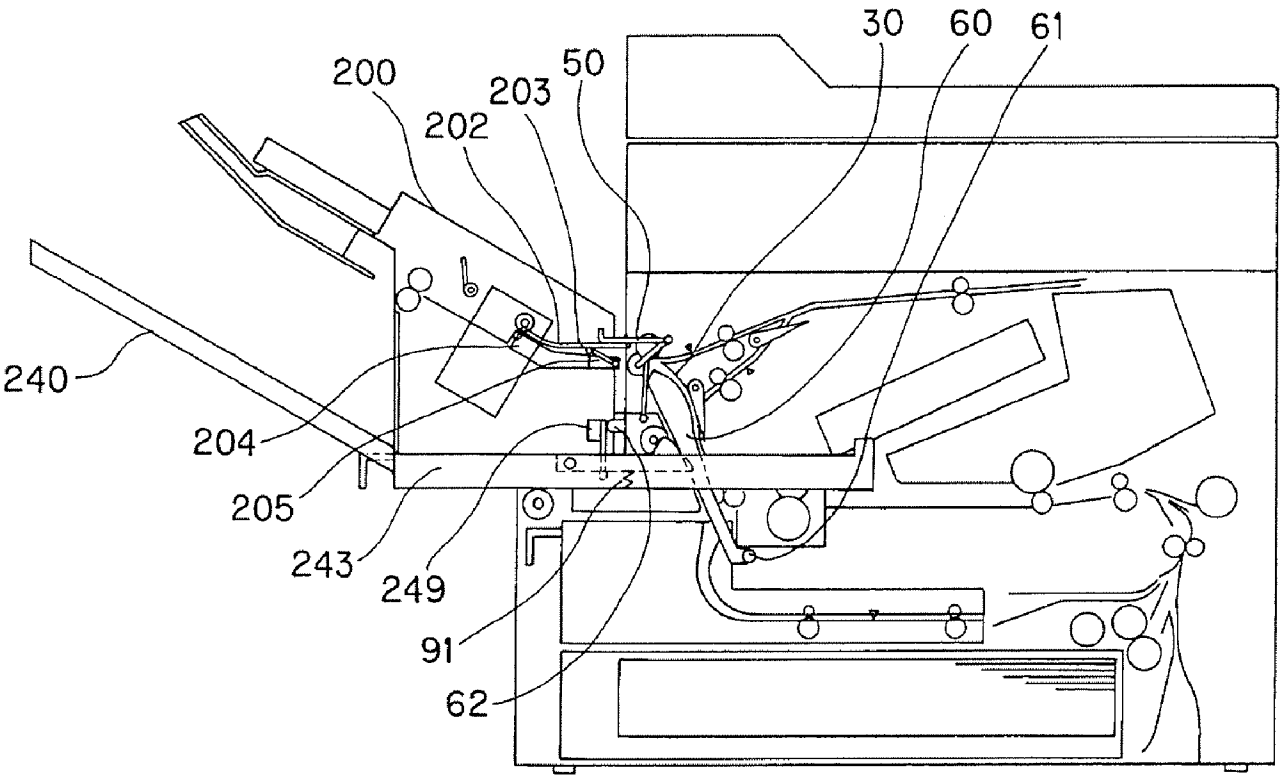
FIG. 3 is a longitudinal sectional view showing schematic configurations of the image forming apparatus and a sheet post-processing device according to the first embodiment.

In FIG. 3, a staple stacker 200 capable of adjusting a plurality of sheets and carrying out the processing to put the sheets in a folder is attached as an example of sheet post-processing device.

At first, sliding the discharge tray 40 to a position that can be slid at the maximum, the discharge tray 40 is pulled out from the image forming apparatus 1.

The staple stacker 200 is provided with a rail 243 equivalent to the rail 43 that is disposed on the discharge tray 40. In addition, a flip-up member 247 equivalent to the flip-up member 45 is also disposed (refer to FIG. 4), and the configuration of the interface with respect to the image forming apparatus 1 is the same as the discharge tray 40.

Figure 4:
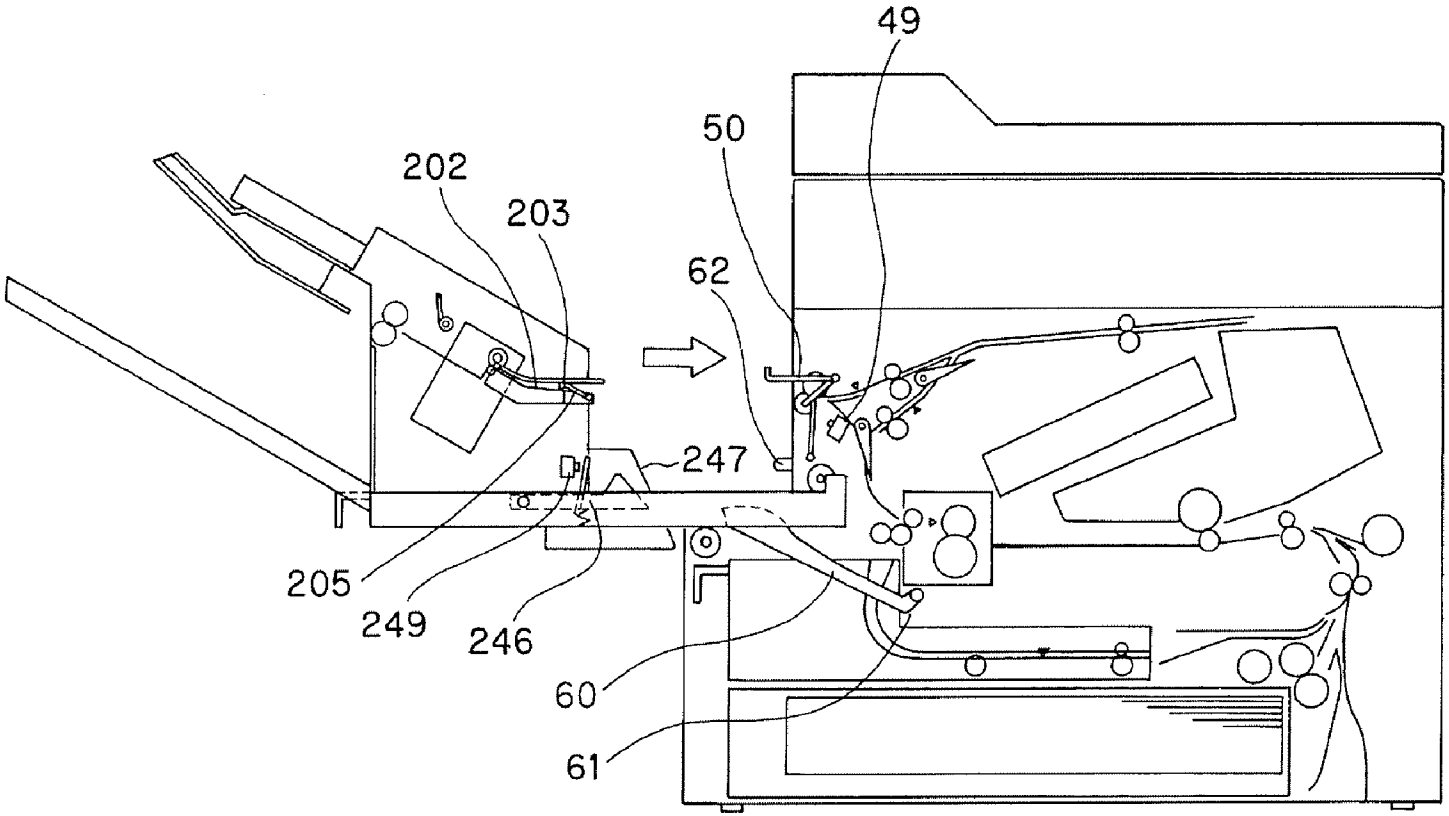
FIG. 4 is a longitudinal sectional view showing a state that the sheet post-processing device according to the first embodiment is not installed.

As shown in FIG. 4, since the interface to be connected to the image forming apparatus 1 is completely the same as the discharge tray 40 in the staple stacker 200, if the discharge tray 40 is slid to the right side in a direction opposite to the process to take out the discharge tray 40, the staple stacker 200 can be attached to the image forming apparatus 1.

The image forming apparatus 1 is provided with a projection 62. In the staple stacker 200, a sheet post-processing device switch 249 and a sheet post-processing device switch member 246 as an example of the attachment detection means are provided. If the staple stacker 200 is not attached to the image forming apparatus 1, the sheet post-processing device switch member 246 is biased by the spring in a clockwise direction.

When the staple stacker 200 is attached on the image forming apparatus 1, the projection 62 presses the sheet post-processing device switch member 246, the sheet post-processing device switch member 246 swings in a counterclockwise direction, and then, the sheet post-processing device switch 249 is turned on.

The staple stacker 200 is provided with one end of a cable (not illustrated) and when the staple stacker 200 is attached to the image forming apparatus 1, the other end of the cable is connected to the image forming apparatus 1. Communication of an electric signal is carried out between the staple stacker 200 and the image forming apparatus 1 via the cable.

In the meantime, in order to detect with or without of the sheet post-processing device, means for detecting that the cable is connected may be provided or by detecting that the image forming apparatus 1 is communicated with the staple stacker 200, with or without of the sheet post-processing device may be detected.

As shown in FIG. 4, even in the case that the stable stacker 200 is pulled out to the left side for the jam clearance processing, one end of the cable has a length enough to prevent separation from the connection to the image forming apparatus 1.

As shown in the table in FIG. 5, there are six patterns of connection conditions of the image forming apparatus 1, the discharge tray 40, and the staple stacker 200. When fully detecting that the discharge tray switch 49 is turned off, the sheet post-processing device switch 249 is turned on, and the staple stacker 200 is electrically connected to the image forming apparatus 1 via the cable, it is recognized that the staple stacker 200 is normally connected to the image forming apparatus 1.

Figure 6:
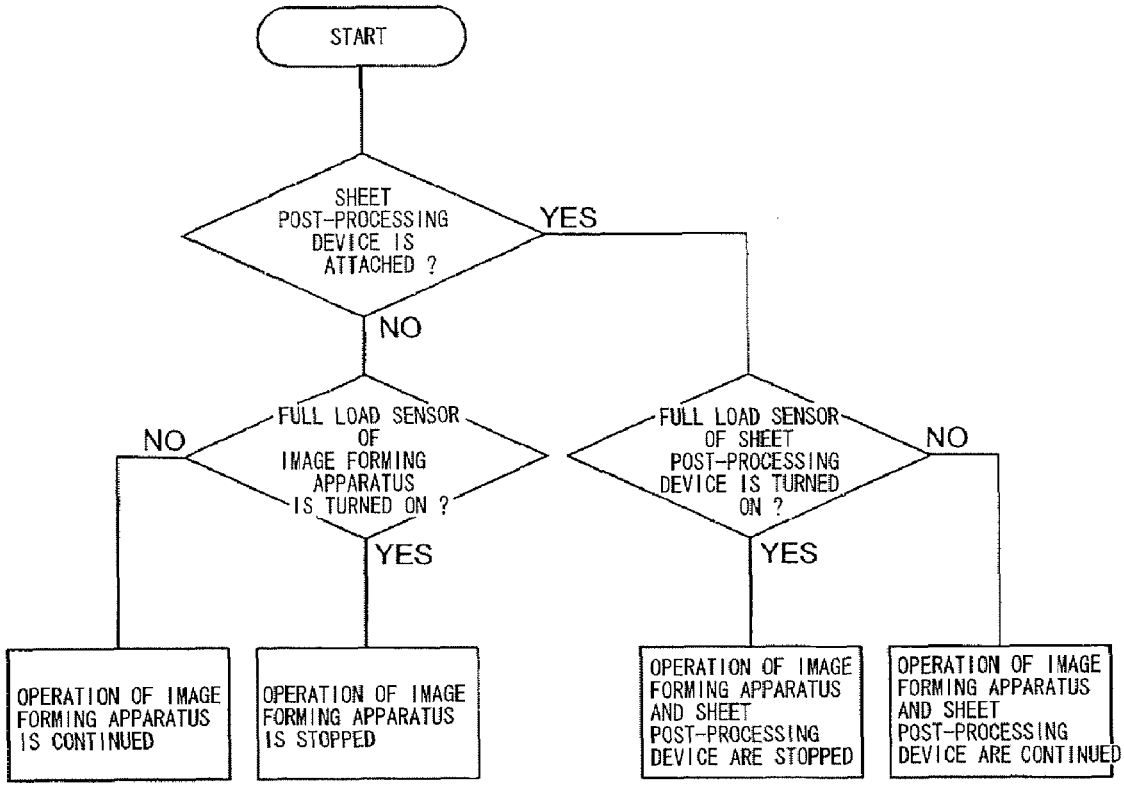
FIG. 6 is a flow chart showing the operation state of the image forming apparatus according to the first embodiment.

Then, when detecting that a full load detection sensor disposed to the staple stacker 200 (not illustrated) is turned off as shown in FIG. 6, the image forming apparatus 1 and the staple stacker 200 may normally operate.

In the next place, the case that the sheet enters in the sheet post-processing device from the image forming apparatus 1 will be described below.

The staple stacker 200 is provided with a sheet carry-in path 202 to receive the sheet discharged from the image forming apparatus 1 and guide the sheet to the next processing and operation.

As shown in FIG. 4, in the vicinity of the sheet carry-in path 202, a sheet in-sensor 203 and an in-sensor flag 205 are disposed as one example of sheet entrance detection means. According to the present embodiment, as the sheet in-sensor 203, a photo sensor is employed.

The sheet transported from the image forming apparatus 1 is carried in the sheet carry-in path 202 within the staple stacker 200 to abut against the in-sensor flag 205. Then, swinging the in-sensor flag 205 about the swing center to shield the light from the sheet in-sensor 203, it is detected that the sheet enters inside of the staple stacker 200.

After that, the staple stacker 200 may carry out a sequence of the post-processing operation on the basis of a signal from the sheet in-sensor 203.

As described above, when the tray 42 moves from the first position to the second position upon loading of the sheet, at the same time, the full load detection sensor flag 50 moves to the removal position. As a result, when carrying out the operation such as the jam clearance or the like in the vicinity of the sheet discharge port, the full load detection sensor flag 50 does not interfere with such operation and the full load detection sensor flag 50 can be prevented from damaged, so that it is possible to provide an apparatus with a high usability and a high reliability.

In addition, the configuration that the full load detection sensor flag 50 moves only when the tray 42 moves from the first position to the second position is described according to the present embodiment, however, it is also possible to obtain the same advantage with respect to the configuration that the full load detection sensor flag 50 moves by attachment and detachment of the sheet post-processing device.

In addition, according to the present embodiment, the configuration that the full load detection sensor flag 50 moves to the removal position by means of the force applying means is described, however, it is also possible to obtain the same advantage with respect to the configuration that the full load detection sensor flag 50 moves to the removal position by using an electronic part such as a motor or the like.

A Second Embodiment

In the next place, the case that the sheet enters in the sheet post-processing device from the image forming apparatus will be described below. In the meantime, the elements described according to the above embodiment are given the same reference numerals and explanation thereof is not repeated here. According to the present embodiment, without providing a flag for an in-sensor to the sheet post-processing device, the full load detection sensor flag 50 of the image forming apparatus 1 functions as the flag for the in-sensor of the sheet post-processing device.

The staple stacker 200 is provided with the sheet carry-in path 202 to receive the sheet discharged from the image forming apparatus 1 and guide the sheet to the next processing and operation.

Figure 9:
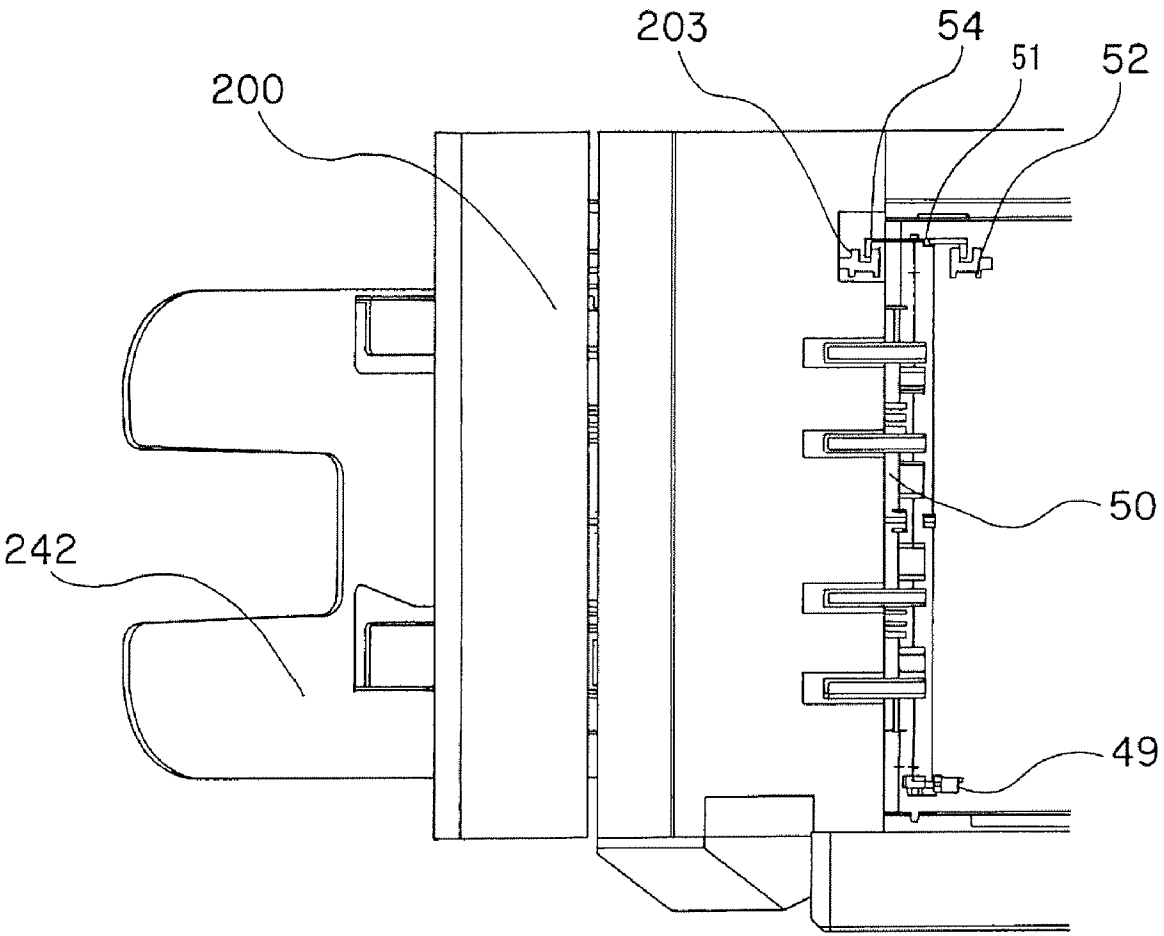
FIG. 9 is a cross sectional view showing schematic configurations of the image forming apparatus and a sheet post-processing device according to the second embodiment.

FIG. 9 is a cross sectional view seeing the connection part of the image forming apparatus 1 and the staple stacker 200 from an upper direction. In the vicinity of the sheet carry-in path 202, the sheet in-sensor 203 is disposed as one example of sheet entrance detection means. According to the present embodiment, as the sheet in-sensor 203, a photo sensor is employed. The full load detection sensor flag 50 is provided with the full load detection sensor light shielding part 53 and an in-sensor light shielding part 54 at the swing center 51 as shown in FIGS. 8A to 8D. The in-sensor light shielding part 54 may shield the light form the sheet in-sensor 203.

Figure 7A:
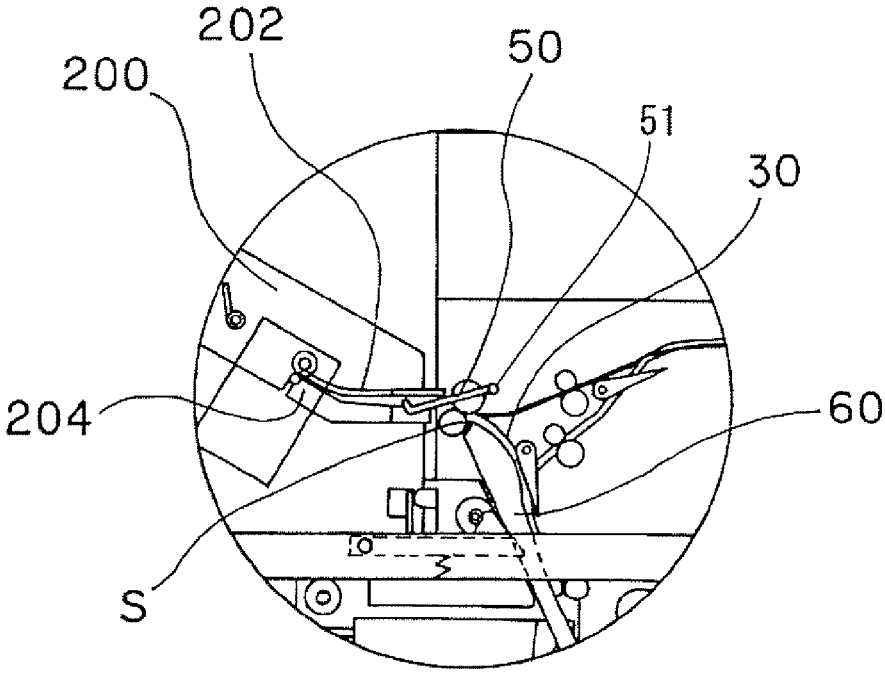
FIGS. 7A and 7B is an enlarged longitudinal sectional view showing the operation of the full load detection sensor flag when a sheet proceeds into the sheet post-processing device from the image forming apparatus according to a second and third embodiment.

FIG. 7A shows a state that a sheet S does not enter the sheet carry-in path 202. In this case, the full load detection sensor flag 50 is located at a predetermined standby position. In this standby position, the front end of the full load detection sensor flag 50 intersects the sheet carry-in path 202 and the full load detection sensor flag 50 is arranged substantially in parallel with a direction of transportation of the sheet so as not to interfere with transportation of the sheet. This standby position is obtained in such a manner that the full load detection sensor flag 50 swings about the swing center 51 by its own weight till it abuts against the discharge tray detection member 46 when the not illustrated projection that is disposed at the exterior part of the staple stacker 200 abuts against the discharge tray detection member 46 and the discharge tray detection member 46 swings to a predetermined position. Since the full load detection sensor light shielding part 53 of the full load detection sensor flag 50 does not shield the light from the full load detection sensor 52 in this time, this state is same as the full loading state. However, since the discharge tray switch 49 is not turned on, the image forming apparatus 1 may ignore a detection signal from the full load detection sensor 52.

Figure 7B:
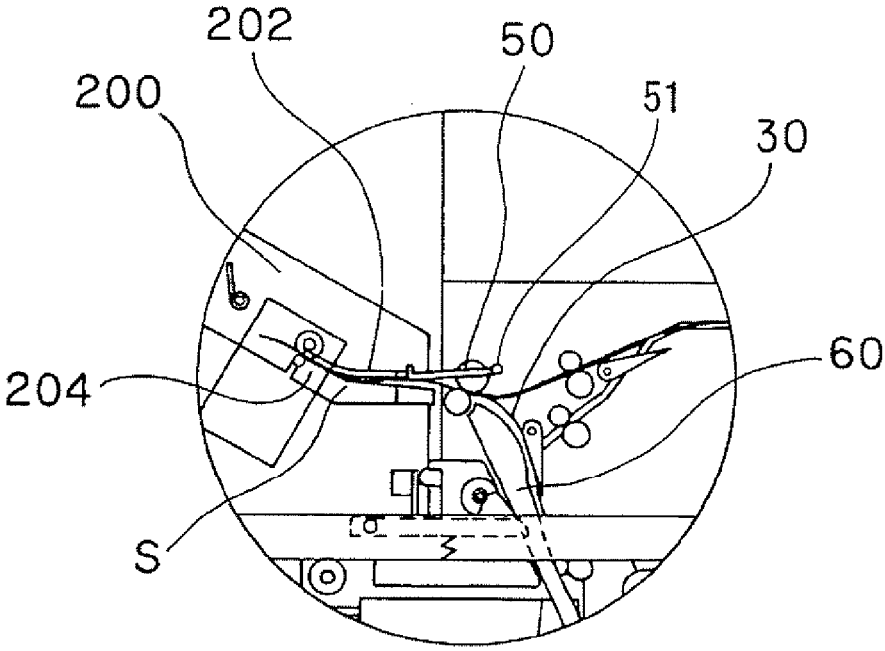

FIG. 7B shows a state that a sheet S enters the sheet carry-in path 202. In this time, the full load detection sensor flag 50 is pressed by the sheet S and the full load detection sensor flag 50 may swing about the swing center 51 to the position where its front end is mounted on the upper surface of the sheet S.

FIGS. 8A to 8D show a positional relation between the full load detection sensor flag 50 and a sheet in-sensor 203. At the swing center 51 of the full load detection sensor flag 50, the full load detection sensor light shielding part 53 and the in-sensor light shielding part 54 are provided. FIG. 8A shows the state that the sheet is not full loaded on the discharge tray 40; FIG. 8B shows the state that the sheet is full loaded on the discharge tray 40; and FIG. 8C shows a position of the full load detection sensor flag 50 when the discharge tray 40 is not attached. Attaching the staple stacker 200, in accordance with swinging of the load detection sensor flag 50, the in-sensor light shielding part 54 shields the light from the sheet in-sensor 203 as shown in FIG. 8D, it is detected that the sheet enters inside of the staple stacker 200.

After that, the staple stacker 200 may carry out a sequence of the post-processing operation on the basis of a signal from the sheet in-sensor 203.

As described above, without providing a flag for an in-sensor to the sheet post-processing device, the full load detection sensor flag 50 of the image forming apparatus 1 functions as the flag for the in-sensor of the sheet post-processing device, so that since the number of parts is decreased, the cost can be lowered, and since the configuration of the apparatus is simplified, it is possible to provide an apparatus with a high reliability.

According to the present embodiment, the configuration that the sheet post-processing device can be attached when the discharge tray 40 of the image forming apparatus 1 is taken off is described as above, however, according to the image forming apparatus 1 and the sheet post-processing device that are configured so as to attach the sheet post-processing device at the discharge port of the image forming apparatus 1 without taking off the discharge tray 40, the same advantage can be obtained.

A Third Embodiment

In the next place, the case that the sheet post-processing device is attached to the image forming apparatus 1 and the full load detection sensor at the side of the image forming apparatus 1 functions as the in-sensor for carrying the sheet from the image forming apparatus 1 to the sheet post-processing device will be described below. In the meantime, the matters described according to the above-described embodiments are given the same reference numerals and the explanation thereof is not repeated here.

Figure 11:
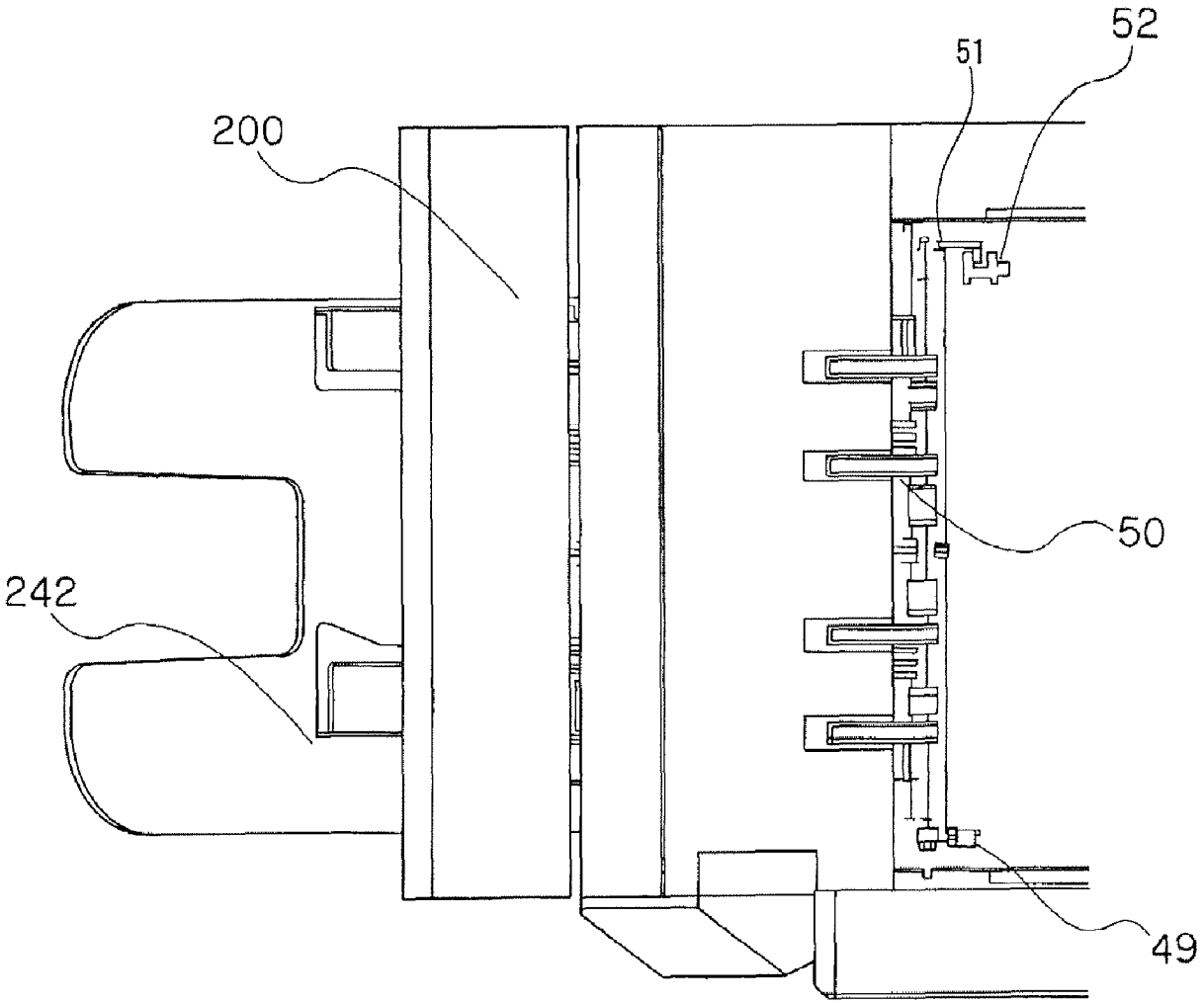
FIG. 11 is a cross sectional view showing schematic configurations of an image forming apparatus and a sheet post-processing device according to the third embodiment.

FIG. 11 is a cross sectional view seeing the connection part of the stable stacker 200 and the image forming apparatus 1 from an upper direction. In the vicinity of the swing center 51 of the full load detection sensor flag 50, the full load detection sensor 52 as an example of the sheet detection means is provided. According to the present embodiment, as the full load detection sensor 52, a photo sensor is employed. As shown in FIG. 10, the full load detection sensor flag 50 is provided with the full load detection sensor light shielding part 53 and the in-sensor light shielding part 54 at the swing center 51. The full load detection sensor light shielding part 53 and the in-sensor light shielding part 54 may shield the light from the full load detection sensor 52.

When the sheet S does not enter the stable stacker 200 as shown in FIG. 7A, the full load detection sensor flag 50 described according to the first embodiment is located at a predetermined removal position. This predetermined removal position is a position where the front end of the full load detection sensor flag 50 intersects the sheet carry-in path 202.

FIGS. 10A to 10D show a positional relation between the full load detection sensor flag 50 and the full load detection sensor 52. FIG. 10A shows the state that the sheet is not full loaded on the discharge tray 40 and FIG. 10B shows a position of the full load detection sensor flag 50 upon the full loading. When the discharge tray 40 is not attached, the full load detection sensor light shielding part 53 may swing only to a position where the full load detection sensor light shielding part 53 does not shield the light from the full load detection sensor 52 as shown in FIG. 10C. The control of the full load detection sensor 52 may switch from a sensor for detecting the number of the sheets on the discharge tray 40 of the image forming apparatus 1 into a sensor for detecting the sheet to be carried in the staple stacker 200 (FIG. 10D) when it is detected that the staple stacker 200 is normally connected to the image forming apparatus 1.

As shown in FIG. 7B, the full load detection sensor flag 50 is pressed by the sheet S which is transported to the staple stacker 200 and the full load detection sensor flag 50 may swing about the swing center 51 to the position where its front end is mounted on the upper surface of the sheet S. Accordingly, as shown in FIG. 10D, the in-sensor light shielding part 54 passes through the full load detection sensor 52; the full load detection sensor 52 detects that the sheet enters the staple stacker 200; and transmits an electric signal to the staple stacker 200 via the cable (not illustrated). After that, the staple stacker 200 may carry out a sequence of the post-processing operation on the basis of a signal from the image forming apparatus 1.

As described above, without providing an sheet in-sensor to the sheet post-processing device, the full load detection sensor 52 of the image forming apparatus 1 functions as the sheet in-sensor of the sheet post-processing device, so that since the configuration of the connection part of the image forming apparatus 1 and the sheet post-processing device is simplified and the number of parts is decreased, the cost can be lowered, and the configuration is simplified, thus it is possible to provide an apparatus with a high reliability.

According to the present embodiment, the configuration that the sheet post-processing device can be attached after the full load detection sensor flag 50 moves to the predetermined removal position when the discharge tray 40 of the image forming apparatus 1 moves from the first predetermined position to the second predetermined position when the sheet is loaded is described, however, also according to the configuration that the full load detection sensor flag 50 moves to the predetermined removal position by attaching the sheet post-processing device to the image forming apparatus 1 that is configured so that it is possible to attach the sheet post-processing device to the discharge port of the image forming apparatus 1 without moving the discharge tray 40 to the second predetermined position, the same advantage can be obtained.

A Fourth Embodiment

In addition, also according to the configuration that the loading part moves from the first position to the second position with folded, the same advantage can be obtained. In the meantime, the matters described according to the above-descried embodiments are given the same reference numerals and its explanation is not repeated here.

Figure 12:
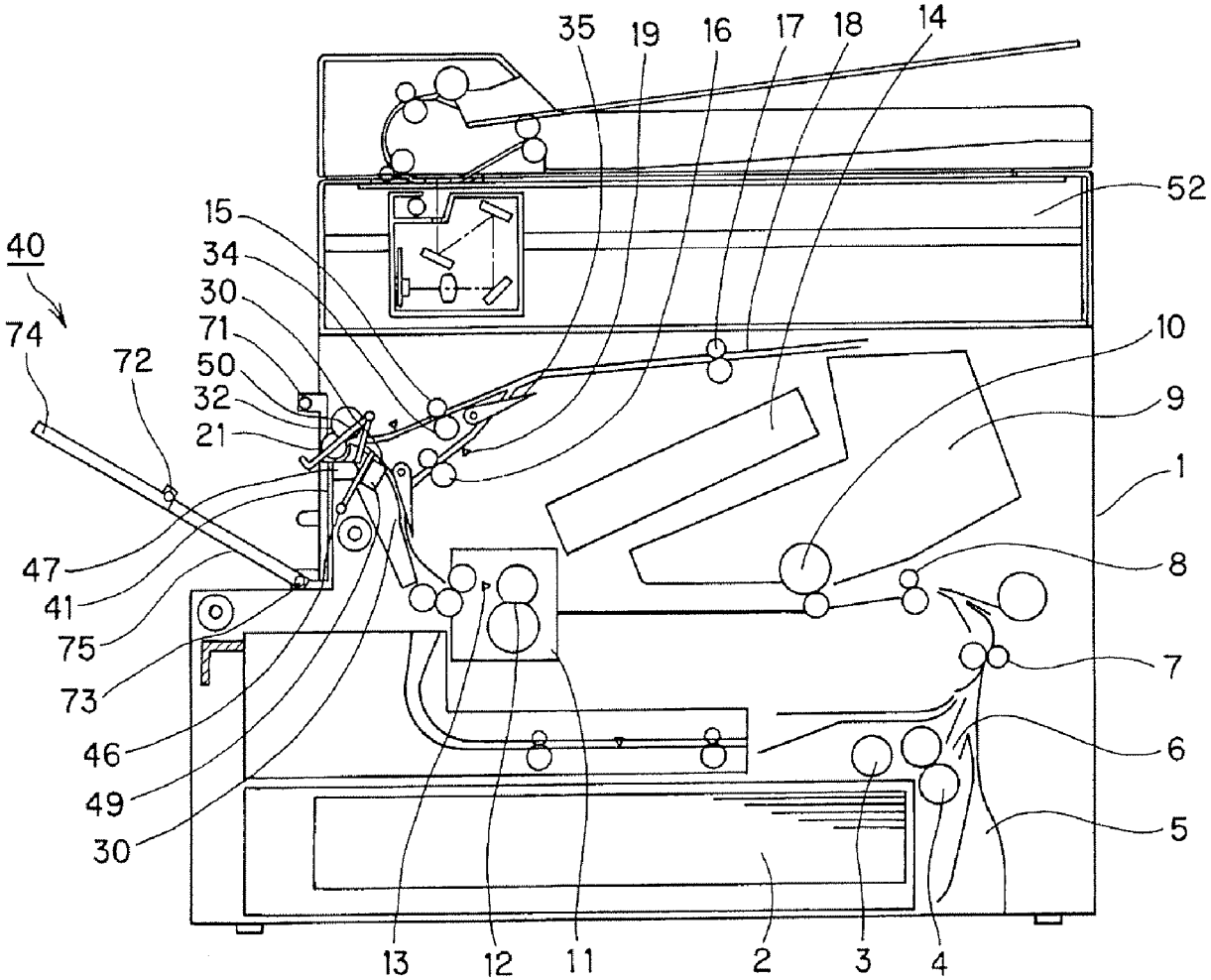
FIG. 12 is a longitudinal sectional view showing a schematic configuration of an image forming apparatus according to a fourth embodiment.

The configuration that a sub tray 74, a base tray 75, and the load wall 41 constructing the loading part of the discharge tray 40 are folded to move from the first position to the second position will be described below. As shown in FIG. 12, the sub tray 74 may swing centering on a swing center 72 in a clockwise direction to move on the base tray 74. In the next place, the base tray 75 may swing about the swing center 73 in a clockwise direction to move to a predetermined position in front of the load wall 41.

Figure 13:
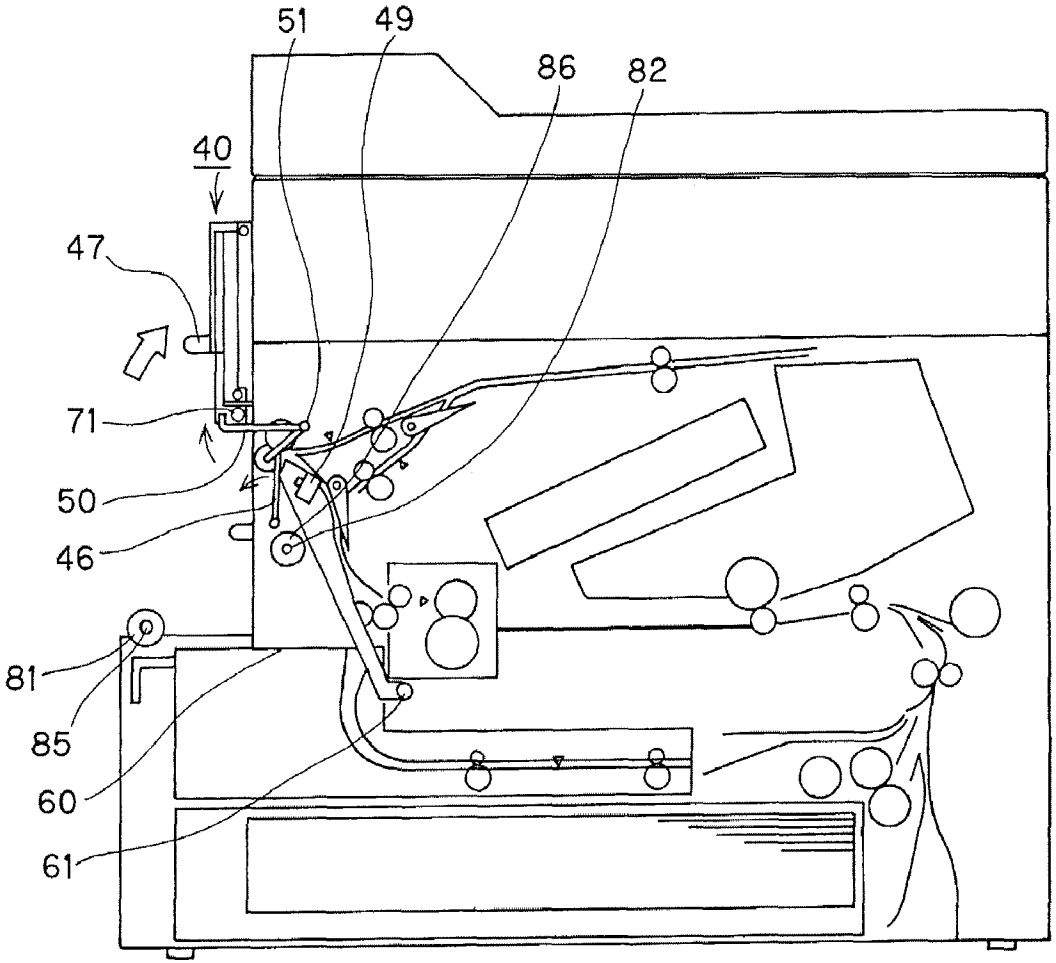
FIG. 13 is a longitudinal sectional view showing a state that a discharging tray of the image forming apparatus according to the fourth embodiment is folded.

Further, the sub tray 74, the base tray 75, and the load wall 41 that are folded as shown in FIG. 13 may swing from the first position to the second position about a swing center 71 in a clockwise direction to move to the second position. In this case, the projection 47 is separated from the discharge tray detection member 46 and the discharge tray detection member 46 is biased by the spring to swing to a predetermined position. In this case, the discharge tray detection member 46 flips up the full load detection sensor flag 50, and the full load detection sensor flag 50 may swing to a predetermined removal position. The removal position of the full load detection sensor flag 50 is a position where the user's hand does not contact the full load detection sensor flag 50 when the user inserts his or her hand inside of the image forming apparatus 1.

This application claims priority from Japanese Patent Applications No. 2003-426693 filed Dec. 24, 2003 and No. 2004-323235 filed Nov. 8, 2004, which are hereby incorporated by reference herein.

What is claimed is:

1. An image forming apparatus comprising:

a main body of the apparatus which forms an image on a sheet;

a discharge tray which can move between a first position capable of loading a sheet discharged from the main body of the apparatus and a second position not capable of loading a sheet discharged from the main body of the apparatus;

a sheet loading amount detection sensor, disposed at the main body of the apparatus, which detects a sheet detection flag moveable between a detecting position capable of detecting a loading amount of the sheet loaded on the discharge tray and a removal position not capable of detecting the sheet loading amount, wherein movement of the sheet detection flag to the removal position allows greater access to the apparatus for jam removal;

a discharge tray detector member engaging with the sheet detection flag for movement of the sheet detection flag; and a projection on said discharge tray, said projection engaging with said discharge tray detector member when said discharge tray is in the first position, wherein when the discharge tray is moved from the first position to the second position, said projection disengages from said discharge tray detector member and the sheet detection flag moves to the removal position.

2. An image forming apparatus according to claim 1, further comprising a position detection sensor which detects that the discharge tray is located at the first position.

3. An image forming apparatus according to claim 1, wherein an operational space to maintain the apparatus is formed by releasing a transport guide to outside of the main body of the apparatus in accordance with the moving of the discharge tray to the second position.

4. An image forming apparatus according to claim 1, wherein a sheet post-processing device which performs the processing to the discharged sheet is attachable to the main body of the apparatus when the sheet detection flag is moved to the removal position while the discharge tray is not located at the first position.

5. An image forming apparatus according to claim 4, further comprising an attachment detection sensor which detects that the sheet post-processing device is attached to the main body of the apparatus.

6. An image forming apparatus according to claim 5, wherein the image forming apparatus recognizes a normal connection of the sheet post-processing device to the main body of the apparatus by detecting an attachment of the sheet post-processing device to the main body of the apparatus, and detecting an electric connection between the main body of the apparatus and the sheet post-processing device, when the discharge tray is not located at the first position.

7. An image forming apparatus according to claim 4, wherein the sheet detection flag is located at a standby position intersecting a sheet carry-in path of the sheet post-processing device when the sheet post-processing device is connected to the main body of the apparatus.

8. An image forming apparatus according to claim 7, wherein the sheet detection flag is movable to a sheet entrance detection position when the sheet enters the sheet post-processing device from the main body of the apparatus.

9. An image forming apparatus according to claim 8, wherein a sheet entrance detection sensor that is disposed at the sheet post-processing device detects that the sheet detection flag moves to the sheet entrance detection position.

10. An image forming apparatus according to claim 8, wherein a sheet entrance detection sensor that is disposed at the main body of the apparatus detects that the sheet detection flag moves to the sheet entrance detection position.

11. An image forming apparatus according to claim 10, wherein the sheet loading amount detection sensor functions as the sheet entrance detection sensor.

12. An image forming apparatus comprising:

a main body of the apparatus which forms an image on a sheet;

a discharge tray which can move between a first position capable of loading a sheet discharged from the main body of the apparatus and a second position not capable of loading a sheet discharged from the main body of the apparatus;

a sheet loading amount detection sensor, disposed at the main body of the apparatus, which detects a sheet detection flag moveable between a detecting position capable of detecting a loading amount of the sheet loaded on the discharge tray and a removal position not capable of detecting the sheet loading amount; and a moving unit which moves the sheet detection flag between the detecting position and the removal position, wherein when the discharge tray is moved to the second position, the sheet detection flag is moved to the removal position from the detecting position by the moving unit, and wherein an operational space to maintain the apparatus is formed by releasing a transport guide to outside of the main body of the apparatus in accordance with the moving of the discharge tray to the second position.

13. An image forming apparatus according to claim 12, further comprising a position detection sensor which detects that the discharge tray is located at the first position.

14. An image forming apparatus according to claim 12, wherein a sheet post-processing device which performs the processing to the discharged sheet is attachable to the main body of the apparatus when the sheet detection flag is moved to the removal position while the discharge tray is not located at the first position.

15. An image forming apparatus according to claim 14, further comprising an attachment detection sensor which detects that the sheet post-processing device is attached to the main body of the apparatus.

16. An image forming apparatus according to claim 15, wherein the image forming apparatus recognizes a normal connection of the sheet post-processing device to the main body of the apparatus by detecting an attachment of the sheet post-processing device to the main body of the apparatus, and detecting an electric connection between the main body of the apparatus and the sheet post-processing device, when the discharge tray is not located at the first position.

17. An image forming apparatus according to claim 14, wherein the sheet detection flag is located at a standby position intersecting a sheet carry-in path of the sheet post-processing device when the sheet post-processing device is connected to the main body of the apparatus.

18. An image forming apparatus according to claim 17, wherein the sheet detection flag is movable to a sheet entrance detection position when the sheet enters the sheet post-processing device from the main body of the apparatus.

19. An image forming apparatus according to claim 18, wherein a sheet entrance detection sensor that is disposed at the sheet post-processing device detects that the sheet detection flag moves to the sheet entrance detection position.

20. An image forming apparatus according to claim 18, wherein a sheet entrance detection sensor that is disposed at the main body of the apparatus detects that the sheet detection flag moves to the sheet entrance detection position.

21. An image forming apparatus according to claim 20, wherein the sheet loading amount detection sensor functions as the sheet entrance detection sensor.

* * * * *